United States Patent [19]

Imai et al.

[11] 4,033,034

[45] July 5, 1977

[54] INNER BLADE MEMBER FOR ELECTRIC DRY SHAVER

[75] Inventors: Hirozo Imai, Hirakata; Yasuo Maeda, Takarazuka, both of Japan

[73] Assignee: Matsushita Electric Works, Ltd., Osaka, Japan

[22] Filed: July 28, 1975

[21] Appl. No.: 599,770

[30] Foreign Application Priority Data

July 31, 1974 Japan ..... 49-88341

[52] U.S. Cl. ..... 30/43.92

[51] Int. Cl.[2] ..... B26B 19/04

[58] Field of Search ..... 30/43.91, 43.92, 42, 30/346.51

[56] References Cited

UNITED STATES PATENTS

| | | | |
|---|---|---|---|
| 3,101,537 | 8/1963 | Kleinman | 30/43.92 |
| 3,290,781 | 12/1966 | Kratz | 30/43.92 X |
| 3,332,146 | 7/1967 | Kratz | 30/43.92 |
| 3,396,463 | 8/1968 | Neumann | 30/43.92 |
| 3,501,836 | 3/1970 | Moret | 30/43.92 |
| 3,579,824 | 5/1971 | Matsumoto | 30/43.92 |

*Primary Examiner*—Gary L. Smith

*Attorney, Agent, or Firm*—Leydig, Voit, Osann, Mayer & Holt, Ltd.

[57] ABSTRACT

Electric dry shaver with reciprocally driven inner blade assembly high in uniform contact pressure distribution against outer blade foil accompanying less frictional heat. The inner blade assembly having parallelly spaced arcuate blades on an elongated semicylindrical frame is coupled substantially at both longitudinal ends of the frame to a connector likewise elongated which transmits to the assembly at the both ends a force urging it to the foil and reciprocal vibrating motion for shaving while the force and motion are given to the connector at its center, preventing arcuate bending of the inner blade assembly.

5 Claims, 10 Drawing Figures

44.4 mm
40 mm
A
B
R
40
30
20
C°
TEMPERATURE
10
0
MINUTE 44.4 mm
10mm
A
B
R
60
50
40
30
20
C°
TEMPERATURE
10
0
MINUTE

δ
P

INNER BLADE MEMBER FOR ELECTRIC DRY SHAVER

This invention relates to reciprocating type electric dry shavers.

Generally, reciprocating type electric dry shavers are provided with a metal foil forming an outer blade and fitted to a frame of shaver body and an inner blade assembly which is reciprocally driven as brought into light contact with inner surface of the outer blade. The inner blade assembly is to be driven by a driving means which is generally an electric motor or vibrator and is required to be high in the mechanical strength and light in the weight. In conventional reciprocating type electric shavers, generally, a die-cast product is used as a carrier for supporting such inner blade assembly, and such die-cast product is high in the mechanical strength but has a defect that it is so heavy in the weight as to require a large driving force for the inner blades. In order to improve this respect, there is suggested such type as, for example, of U.S. Pat. No. 3,724,072 wherein a carrier made of a plastics material for the inner blades is used instead of the die-cast product so as to receive a force for urging the inner blades upward at its intermediate position. Such plastics made carrier is so light in the weight that the inner blade driving force can be reduced but is generally so low in the mechanical strength as to be likely to bend arcuately while it is used. When such plastics made carrier bends, contacting pressure of the inner blades with the outer blade will become nonuniform so that frictional temperature will partially rise and cutting ability will be caused to be reduced. In practice, a clearance will be produced between each end part of the inner blade assembly and the outer blade, the cutting ability will reduce and particularly the middle part of the inner blade assembly will so strongly contact the outer blade that the temperature rise in this part will become large and user's skin will be irritated.

The present invention is suggested to improve the above mentioned defects in conventional shaver referred to. According to the present invention, an inner blade carrier is supported substantially at respective longitudinal ends with a connector which is driven by a driving rod so that the inner blade carrier made of plastics material will be successfully prevented from being arcuately bent.

A primary object of the present invention is to prevent any cutting ability reduction and temperature rise caused by the bending of the inner blade assembly or its carrier by uniformly distributing the contact pressure of the inner blades with the outer blade in the electric dry shaver of a type of reducing the inner blade driving force by using an inner blade carrier made of a plastics material.

Another object of the present invention is to eliminate the assembling difficulty caused by the fluctuation of dimensions in combining an inner blade carrier, that is, an inner blade supporting frame and a connector with each other.

A further object of the present invention is to provide a structure wherein the connector can be easily fitted to the blade supporting frame.

Other objects and advantages of the present invention shall be made clear upon reading the following description wherein the present invention will be explained more in detail with reference to a most preferred embodiment of the invention as shown in accompanying drawings, in which:

FIGS. 4A and 4B are bottom plan views of the inner blade assembly of FIG. 3, wherein FIG. 4A is of a blade supporting frame and FIG. 4B is of a connector;

FIGS. 5A and 5B show the blade supporting frame and the connector of FIGS. 4A and 4B as assembled, wherein FIG. 5A is an elevation thereof with the inner blades and supporting frame sectioned and FIG. 5B is a bottom plan view;

FIGS. 6A and 6B are diagrams showing temperature-time characteristics of the inner blades, wherein FIG. 6A is of a conventional shaver and FIG. 6B is of the shaver according to the present invention, respectively.

Figure 1:
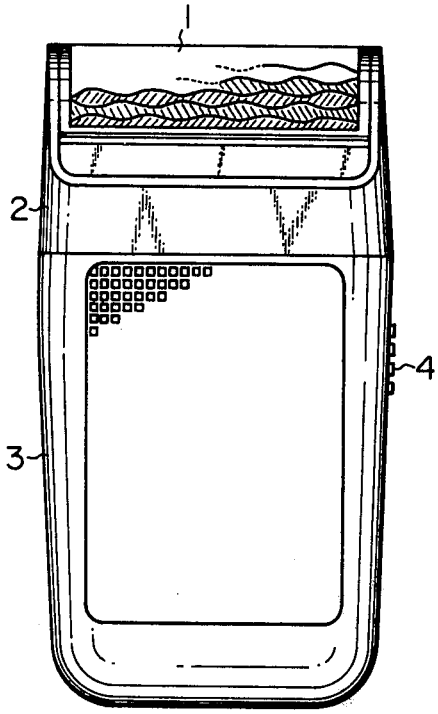
FIG. 1 is an elevation of a reciprocating type electric shaver according to the present invention.

Referring now to FIG. 1 showing a reciprocating type electric dry shaver of the present invention, 1 is an outer blade of a metal foil which is fitted to a frame 2 fixed to a body 3 provided with a switch 4 and containing an inner blade driving means.

Figure 2:
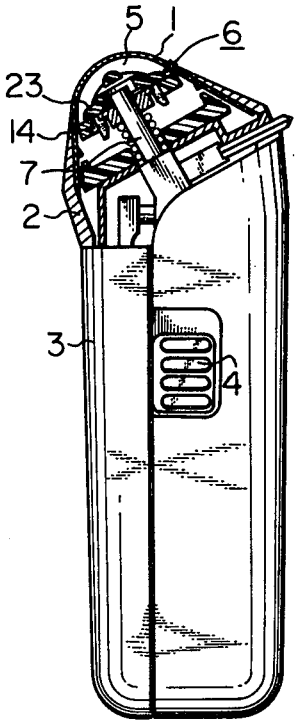
FIG. 2 is a side elevation of the shaver as shown in FIG. 1 with a part vertically sectioned.

As shown in FIG. 2 of a side view of the shaver of the present invention, an inner blade assembly 6 is resiliently pressed against the inside of the outer blade foil 1. A plurality of inner blades 5 respectively of an arcuate shape is fixed to a blade supporting frame, as will be detailed later, and this blade supporting frame is combined with a connector to which a reciprocating motion is given by a driving rod 7 preferably through a fitting member.

Figure 3:
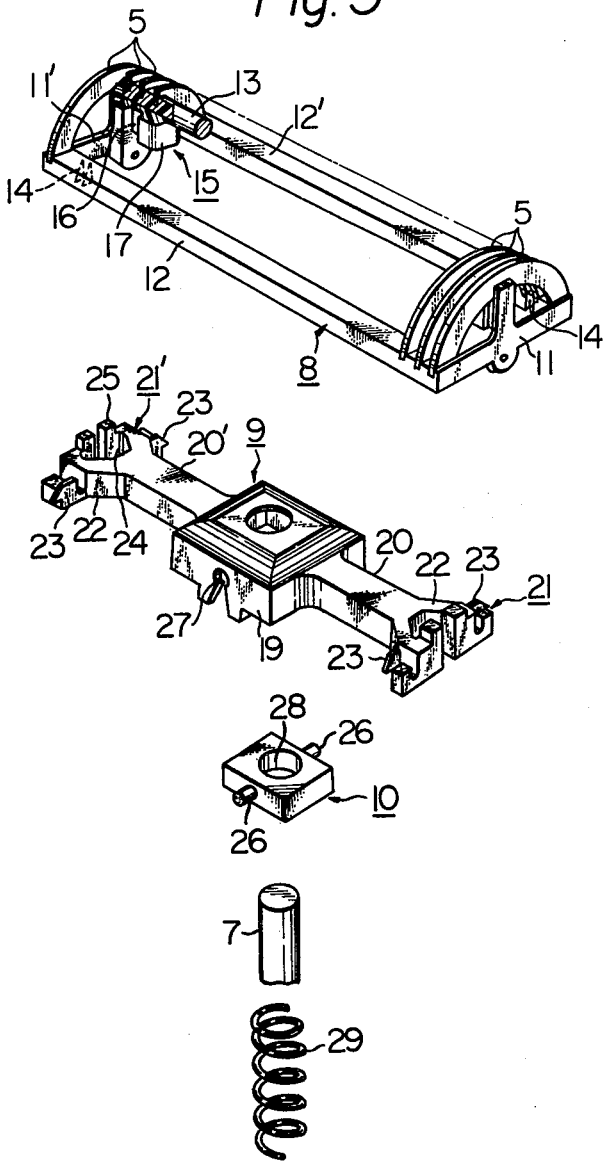
FIG. 3 is a perspective view of an inner blade assembly with a part sectioned and a part of driving means therefor respectively as disassembled and used in the shaver of FIGS. 1 and 2.
Figure 4A:
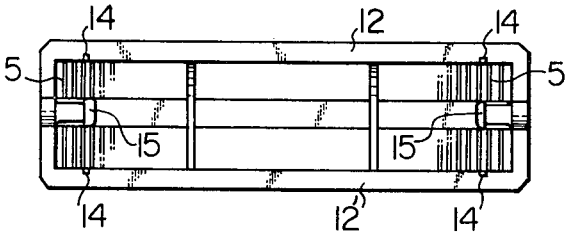

As shown in FIG. 3, the inner blade assembly 6 comprises a blade supporting frame 8 which is made of a plastics material and in which the plurality of blades 5 are integrally molded as fixed to the frame in parallel with each other and at regular intervals, and a connector 9 which is to be coupled integrally with the blade supporting frame 8 at respective longitudinal ends. The formation of this inner blade assembly 6 shall be explained more in detail. The blade supporting frame 8 is formed of end parts 11 and 11′ which are substantially T-shaped, side parts 12 and 12′ connecting respectively both end parts 11 and 11′ at respective lateral ends of them and a central part 13 connecting respective vertical tops of both end parts 11 and 11′. The respective arcuated blades 5 are disposed in parallel with each other at regular intervals and are arranged in position bridging the respective parts 12, 12′ and 13 at the time of molding the frame 8 so as to be integral with the frame. As shown in FIG. 4A, the bottom surface of this blade supporting frame 8 is provided with four notches 14, in the drawing inside the both side parts 12 and 12′. Further, in FIG. 3, 15 is a pair of fitting projections to be fitted with the connector 9, which projections respectively comprise a narrowed part 16 and a convex part 17 and are provided inside each longitudinal end part of the blade supporting frame 8.

Figure 4B:
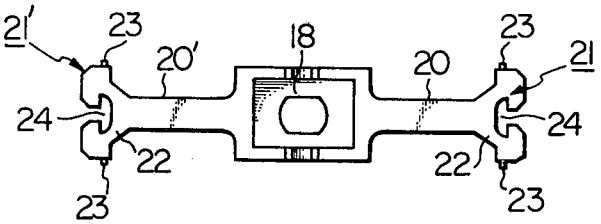

The connector 9 is also made of a plastics material preferably, and comprises a central base part 19 of dimensions freely located in elongated arcuate space of the frame 8 and having a concave part 18 made at central lower surface for inserting therein a fitting member 10, bars 20 and 20′ extending in opposite directions from the base part 19 and engaging parts 21 and 21′ to be engaged to the blade supporting frame 8 respectively in the end parts of the bars 20 and 20′ as seen in FIGS. 3 and 4B. Each of these engaging parts 21 and 21′ is provided with arms 22 formed to be substantially C-shaped and fitting pieces 23 projecting respectively laterally at both sides of the respective arms 22, which fitting pieces 23 forming sloped side edges expanding laterally with respect to longitudinal axis of the extending arms 20, 20′ so as to be hook-shaped. It is necessary that the thickness and length of the respective fitting pieces 23 should be of a dimention that can be inserted into each of the notches 14 provided in the bottom surface of the blade supporting frame 8. A concave part 24 is provided inside the arms 22 so as to allow each of the fitting projections 15 of the frame 8 to fit therein. A pair of projections 25 for pushing up the blade supporting frame 8 with the connector 9 is provided at each end of the arms 22. These projections 25 are adapted to act also as a spacer means so that, when the connector 9 is coupled to the blade supporting frame 8, a predetermined spacing will be kept between them. The above described structure is the same also for the fitting parts 21 and 21′. A notch 27 for inserting a shaft 26 on each side of a fitting member 10 is made on each side of the lower surface of the central base part 19 of the connector 9.

A hole 28 for inserting a driving rod 7 is made in the center of the fitting member 10. 29 is a spring set on the rod 7 for urging the inner blade assembly into light contact with the outer blade.

The coupled state of the blade supporting frame 8 and the connector 9 shall be explained in the following. When the upper surface having the projections 25 of the connector 9 is brought into contact with the lower surface of the blade supporting frame 8, the fitting pieces 23 provided on the arms 22 at both ends of the connector 9 are fitted in the notches 14 on the bottom of the blade supporting frame 8 and the connector 9 is pushed in, the fitting pieces 23 will be urged to bend inward to develop frictional force in a transaxial direction and, when they exceed the heights of both side parts 12, 12′ of the blade supporting frame 8 through the notches 14, the fitting pieces 23 of the connector 9 will open outward under their resiliency, the hook-shaped fitting pieces 23 will engage with and rest on both side parts 12, 12′ of the frame 8, so that the frame 8 and connector 9 will be integrally coupled. In this case, the fitting projections 15 of the blade supporting frame 8 will fit in the respective concave parts 24 at both ends of the connector 9. The projections 15 are so dimensioned that one of the projections will be fitted tightly in the concave part 24 but the other projection will be fitted loosely. This fact shall be described more specifically. One of the fitting projections 15 will be fitted in the concave part 24 tightly with respect to the lengthwise direction of the blade supporting frame 8 so that the frame 8 and connector 9 will be integrally coupled with each other but the other fitting projection 15 will be fitted in the concave part 24 loosely also with respect to the lengthwise direction of the blade supporting frame so that any fluctuation of the dimensions in the lengthwise direction of the connector 9 and the frame 8 at the time of molding them will be absorbed and the connector 9 will be prevented from giving a compressive stress to the blade supporting frame 8. The projections 25 of the connector 9 for pushing up the blade supporting frame will be in contact with the lower surface of the central part 13 of the frame 8 and will keep a desired spacing between the frame and the connector.

The most remarkable feature of such coupling manner of the blade supporting frame 8 and the connector 9 is that the upward urging force by the push-up spring 29 received on the central lower side of the connector will be applied to the blade supporting frame 8 through the projections 25 at both ends of the connector 9. This is a condition of giving the main effect of the present invention described later with reference to FIGS. 6A and 6B.

Figure 5A:
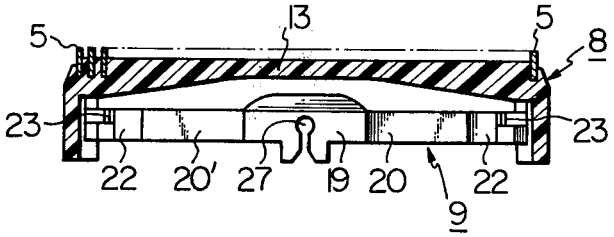
Figure 5B:
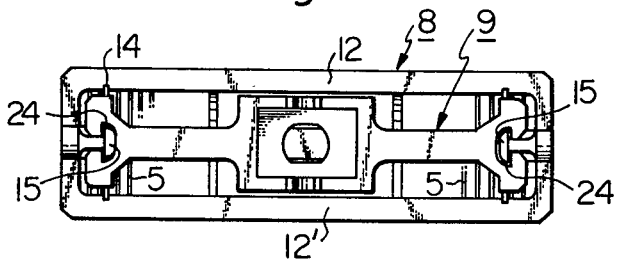

FIGS. 5A and 5B show the coupled state of the blade supporting frame 8 and connector 9, as described above. The inner blade assembly 6 as assembled in the formation of these drawings is installed in the shaver body as shown in FIG. 2.

According to the present invention, as the connector 9 is connected at both ends of the blade supporting frame 8 so that a driving force will be transmitted to the central part of the connector, as described above, there can be provided an electric dry shaver wherein the blade supporting frame can be prevented from bending during the operation of the shaver, thus the reduction of the cutting ability and the local rise of any frictional temperature of the outer blade which irritate the skin of the user's face can be prevented and the load is light.

The difference in operational performances between the present invention and conventional shavers of the type referred to shall be explained next.

Figure 6B:
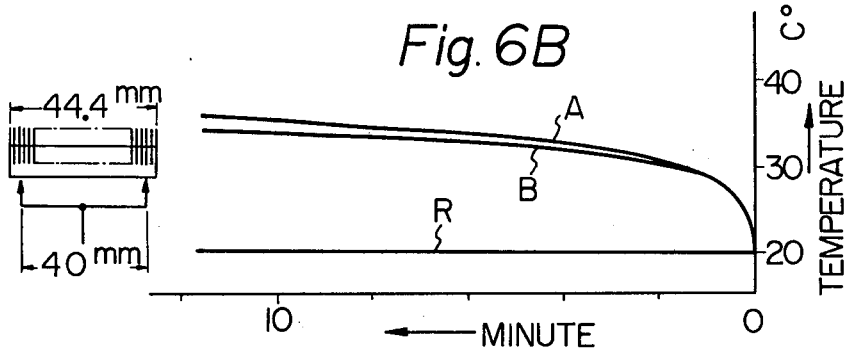
Figure 6A:
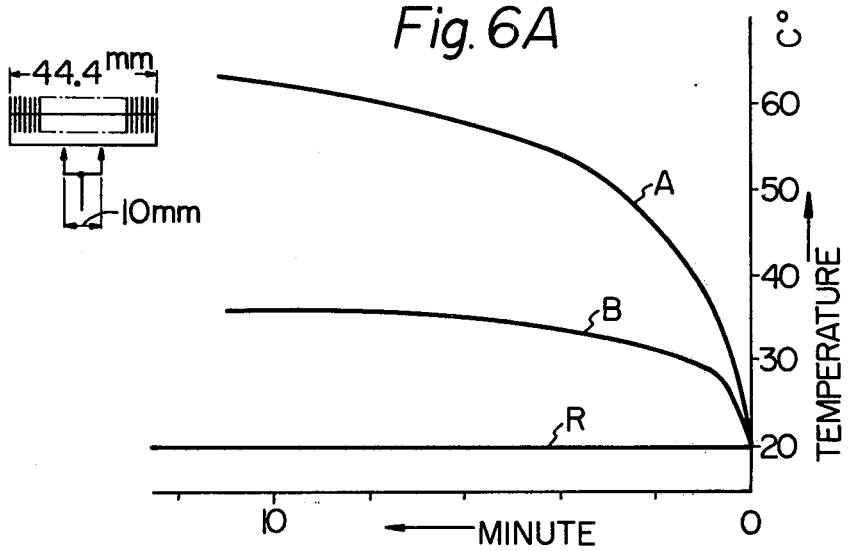

Referring to FIGS. 6A and 6B, temperature-time characteristics of the electric dry shaver blade assembly of the present invention and a conventional type blade assembly shall be compared.

Figure 7:
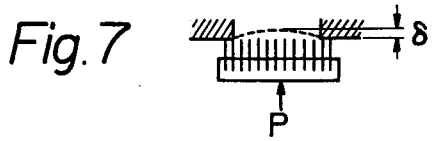
FIG. 7 is an explanatory view showing diagrammatically inner blade bending resiliency.

In the measurement, a blade assembly having 38 of semicircular blades of a radius of 10 mm. and a thickness of 0.12 mm. each and erected at regular intervals and in parallel with each other over a range of 44.4 mm. on the blade supporting frame of a synthetic resin was used. Vibrations of an amplitude of 3.0 mm. and a cycle of 120Hz were given, while inner blades of a bending resiliency (see FIG. 7) ($\delta/P$) (wherein $\delta$ is a bending amount of the inner blade and P is a force of pushing up the inner blade) of 0.1 mm./kg. were kept in contact with a net type outer blade with a push-up force of 400 g. Measurements show that the temperature rises in the central part and longitudinal end parts of the outer blade net. In the diagrams, the curve A represents the temperature in the central part of the net, the curve B represents the temperature in the end part of the net, and the line R represents the room temperature. FIG. 6A shows the temperatures of the conventional product in which the inner blade supporting span was 10 mm., while FIG. 6B shows the temperatures of the product of the present invention in which the inner blade supporting span was 40 mm. Comparing these diagram, it is recognized that, in the present invention, the temperature rise is very slight and is uniform over the entire surface of the blade.

Further, the present invention has features that the assembly of the inner blade members is simply performed by only pressing the fitting pieces 23 of the connector 9 into the respective notches 14 in both side parts 12, 12′ of the blade supporting frame 8, that the connector can be prevented by the hook-shaped parts from being pulled off and that, as one of the fitting parts 15 of the blade supporting frame 8 is tightly fitted in one of the concave parts 24 and the other fitting part 15 is loosely fitted in the other concave part 24, both can be tightly coupled with each other and any fluctuation of dimensions in molding can be effectively absorbed. The term "motor" as used herein includes sources of either rotary or reciprocatory motion.

What is claimed is:

1. An electric dry shaver having a body, a thin, semi-cylindrical outer blade defining a pattern of apertures, a cooperating inner blade assembly formed of a hollow rectangular frame and a stack of semi-annular cutting elements axially spaced in the frame presenting their semi-circular edges to the outer blade, said frame being formed of synthetic plastic with the cutting elements being permanently molded in place therein, a yoke member having arms extending axially in the hollow frame and having means for captively engaging the ends of the arms to the axial ends of the frame at the respective ends of the stack of cutting elements, the engaging means including laterally extending frictional elements which exert purely lateral force in opposed directions against the side walls of the frame free of generation of longitudinal stress in the frame, a driving means including a motor in the body, said driving means further including a reciprocated driving member coupling the motor to the central portion of the yoke member for axially reciprocating the yoke member, the engaging means further including cooperating surfaces at one end of the yoke member and frame to provide positive endwise driving engagement for thereby reciprocating the frame of the inner blade assembly, and a push-up spring at the central portion of the yoke member for urging it and the inner blade assembly toward the outer blade.

2. The combination as claimed in claim 1 in which both the yoke and the frame are made of synthetic plastic and in which the means for captively engaging the end of each arm to the respective ends of the frame include a transaxial telescoping projection on one of the members and a registering recess in the other, the projection and cooperating recess having an axially tight fit at one end of the frame and an axially loose fit in both axial directions at the other to accommodate variations in longitudinal dimension between the frame and the yoke thereby to avoid longitudinal stress in the frame.

3. The combination as claimed in claim 1 in which both the yoke and the frame are made of synthetic plastic and in which the frictional elements are in the form of laterally extending hook members providing interfering frictional engagement with the inside of the frame for holding the yoke assembled in nested position with respect to the frame.

4. The combination as claimed in claim 1 in which the central part of the yoke includes laterally spaced side walls defining a central hollow space, a drive coupling in the hollow space, the driving member engaging the drive coupling for transmission of reciprocating movement thereto, the drive coupling having a transverse pivot connection with the side walls of the yoke to accommodate any angular component of motion of the drive member, the drive coupling being interposed between the push-up spring and the yoke.

5. An electric dry shaver having a body, a thin, semi-cylindrical outer blade defining a pattern of apertures, a cooperating inner blade assembly formed of a hollow rectangular frame and a stack of semi-annular cutting elements axially spaced in the frame presenting their semi-circular edges to the outer blade, said frame being formed of synthetic plastic with the cutting elements being permanently molded in place therein, a yoke member having arms extending axially in the hollow frame, the arms of the yoke each having a pair of laterally extending sharply pointed hook members extending in opposite directions for engaging the inside of the frame adjacent the ends thereof for keeping the yoke in assembled relation with the frame, the arms of the yoke being split into C configuration at the respective ends to provide resilient outward springing for the hook members against the inside of the frame, a driving means including a motor in the body, said driving means further including a reciprocated driving member coupling the motor to the central portion of the yoke member for axially reciprocating the yoke member and thereby reciprocating the frame of the inner blade assembly, and a push-up spring at the central portion of the yoke member for urging it and the inner blade assembly toward the outer blade.

* * * * *